US005388595A

United States Patent [19]

Shafer

[11] Patent Number: 5,388,595

[45] Date of Patent: Feb. 14, 1995

[54] SECOND-HAND SMOKE FILTERING DEVICE

[76] Inventor: Gary A. Shafer, 2325 Prince St. #2, Los Angeles, Calif. 90031

[21] Appl. No.: 258,475

[22] Filed: Jun. 10, 1994

[51] Int. Cl.[6] ..... A24F 13/02

[52] U.S. Cl. ..... 131/329; 131/175; 131/185; 131/206; 131/215.3

[58] Field of Search ..... 131/329, 330, 175, 185, 131/187, 190, 201, 202, 206, 215.1, 215.2, 215.3

[56] References Cited

U.S. PATENT DOCUMENTS

| | | | |
|---|---|---|---|
| 2,108,218 | 2/1938 | Stultz | 131/175 |
| 2,974,669 | 3/1961 | Ellis | 131/190 |
| 4,043,776 | 8/1977 | Orel . | |
| 4,148,328 | 4/1979 | Fox | 131/175 |
| 4,200,114 | 4/1980 | Waite | 131/178 |
| 4,790,332 | 12/1988 | Wallace | 131/175 |
| 4,899,766 | 2/1990 | Ross, Jr. . | |
| 4,993,435 | 2/1991 | McCann | 131/175 X |
| 5,048,545 | 9/1991 | Takagi et al. . | |
| 5,160,518 | 11/1992 | Vega, Jr. . | |
| 5,186,165 | 2/1993 | Swann . | |

*Primary Examiner*—Jennifer Bahr

[57] ABSTRACT

A second-hand smoke filtering device having a hollow body; a cigarette holder disposed within the body and further having a holding chamber for the dual purpose of accepting a cigarette therein and for holding second-hand smoke; an igniter mechanism disposed within the holding chamber for lighting a cigarette when activated; and a drive mechanism coupled to the igniter mechanism for allowing the igniter mechanism to be moved forward or backward; a mouthpiece extended from the body for receiving smoke from the cigarette holder or holding chamber and transmitting second-hand smoke; a filter compartment disposed within the body for removing second-hand smoke; a valve mechanism disposed between the cigarette holder, mouthpiece, holding chamber, and filter compartment for controlling communication between the holding chamber, mouthpiece, cigarette holder, and filter compartment; and a selection mechanism coupled to the igniter mechanism, drive mechanism, and valve mechanism for allowing a user to activate and deactivate the igniter mechanism, move the igniter mechanism forward or backward, and control communication between the holding chamber, mouthpiece, cigarette holder, and filter compartment.

5 Claims, 6 Drawing Sheets

SECOND-HAND SMOKE FILTERING DEVICE

BACKGROUND OF THE INVENTION

1. Field of the Invention

The present invention relates to a second-hand smoke filtering device and more particularly pertains to capturing and filtering cigarette smoke from the air with a second-hand smoke filtering device.

2. Description of the Prior Art

The use of smoke filtering devices is known in the prior art. More specifically, smoke filtering devices heretofore devised and utilized for the purpose of capturing and filtering cigarette smoke are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,043,776 to Orel discloses a smoke absorbing device. U.S. Pat. No. 4,899,766 to Ross, Jr. discloses a secondary smoke catcher. U.S. Pat. No. 5,048,545 to Takagi et al. discloses a smoking device. U.S. Pat. No. 5,160,518 to Vega, Jr. discloses a second chance secondary smoke trap. U.S. Pat. No. 5,186,165 lto Swann discloses a filtering canister with deployable hood and mouthpiece.

While these devices fulfill their respective, particular objective and requirements, the aforementioned patents do not describe a second-hand smoke filtering device that is portable in design and allows a user to control the generation and filtering of cigarette smoke and second-hand cigarette smoke.

In this respect, the second-hand smoke filtering device according to the present invention substantially departs from the conventional concepts and designs of the prior art, and in doing so provides an apparatus primarily developed for the purpose of capturing and filtering second-hand smoke from a user smoking cigarettes.

Therefore, it can be appreciated that there exists a continuing need for new and improved second-hand smoke filtering device which can be used for capturing and filtering second-hand smoke from a user smoking cigarettes. In this regard, the present invention substantially fulfills this need.

SUMMARY OF THE INVENTION

In the view of the foregoing disadvantages inherent in the known types of smoke filtering devices now present in the prior art, the present invention provides an improved second-hand smoke filtering device. As such, the general purpose of the present invention, which will be described subsequently in greater detail, is to provide a new and improved second-hand smoke filtering device and method which has all the advantages of the prior art and none of the disadvantages.

To attain this, the present invention essentially comprises, in combination, a hollow body. A cigarette holder is included and integrally coupled to the body. The cigarette holder is encapsulated by an elongated holding chamber having an opening adapted for allowing a user to place a cigarette therein for smoking. The cigarette holder has an output port adapted for transmitting cigarette smoke. The enlongated holding chamber includes an igniter disposed within the holding chamber and having an energized orientation for allowing the lighting of a cigarette and de-energized orientation for preventing the lighting of a cigarette. The holding chamber includes an elongated worm gear having a first end and a second end with the second end extended within the holding chamber and coupled to the igniter. The holding chamber includes a gear motor having a fixed stator and a rotatable rotor disposed within the body with the rotor coupled to the first end of the worm gear for allowing the igniter to be moved forward in one orientation and backwards in another orientation with the forward orientation adapted for placing the igniter in contact with a tip of a cigarette for lighting. The holding chamber includes a transparent holding chamber door pivotally coupled to the holding chamber near the opening with the door adapted to seal the opening and prevent smoke from escaping. The holding chamber includes a one-way valve disposed on the holding chamber adapted for allowing air external to the body to enter and preventing smoke from escaping.

A tubular mouthpiece is included and disposed within and extended from the body with the mouthpiece adapted for receiving smoke from a cigarette in the cigarette holder or smoke suspended within the holding chamber when a user inhales and transmitting second-hand smoke when a user exhales. A holding chamber is included and disposed within the body for holding second-hand smoke with the holding chamber further having a port adapted for transmitting second-hand smoke. A filter compartment is disposed within the body for removing second-hand smoke. The filter compartment includes an elongated filter chamber having an input port adapted for receiving second-hand smoke and an exhaust port adapted for transmitting filtered air to a location external to the body. The filter compartment includes a replaceable filter disposed between the input port and the exhaust port for removing the second-hand cigarette smoke with the filter having a fiber-filled section positioned adjacent to the input port, a perfumed pellet section positioned adjacent to the exhaust port and a charcoal-filled section therebetween. The filter compartment includes a fan disposed between the exhaust port and the filter for removing filtered air from the filter chamber.

A filter door is included and disposed on the body for allowing access to the filter in the filter compartment. A rigid quadrature check valve is included and has four tubular sections intersected at a common junction to define a first port, a second port, a third port, and a fourth port with the second port coupled to the output port of the cigarette holder, the first port coupled to the mouthpiece, the third port coupled to the ouotput port of the holding chamber, and the fourth port coupled to the input port of the filter compartment. The check valve also includes a first solenoid valve disposed within the first port, a second solenoid valve disposed within the second port, a third solenoid valve disposed within the third port, and a fourth solenoid valve disposed within the fourth port with each valve having an opened orientation when electrically energized for allowing communication therethrough an a closed orientation when de-energized for preventing communication therethrough. A power source is included and disposed within the body and coupled to the gear motor, fan, and solenoid valves. A power source door is included and disposed on the body for allowing access to the power source. Drive circuitry is included and disposed within the body and coupled between the gear motor and the power source with the drive circuitry having a switch coupled thereto and extended from the body with the switch adapted for allowing a user to control the forward and rearward motion of the igniter for lighting a cigarette. Lastly, selection circuitry is included and disposed within the body and coupled between the fan, solenoid valves, and power source with the selection circuitry having a plurality of switches coupled thereto and extended from the body with the switches adapted for allowing a user to place selected solenoid valves in the opened orientation and the closed orientation and the igniter in an energized orientation and a de-energized orientation, whereby enabling a user to control the lighting of a cigarette as well as the communication of second-hand smoke between the cigarette holder, mouthpiece, holding chamber, and filter compartment.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved second-hand smoke filtering device which has all the advantages of the prior art smoke filtering devices and none of the disadvantages.

It is another object of the present invention to provide a new and improved second-hand smoke filtering device which may be easily and efficiently manufactured and marketed.

It is a further object of the present invention to provide a new and improved second-hand smoke filtering device which is of durable and reliable construction.

An even further object of the present invention is to provide a new and improved second-hand smoke filtering device which is susceptible of a low cost of manufacture with regard to both materials and labor, and which accordingly is then susceptible of low prices of sale to the consuming public, thereby making such a second-hand smoke filtering device economically available to the buying public.

Still yet another object of the present invention is to provide a new and improved second-hand smoke filtering device which provides in the apparatuses and methods of the prior art some of the advantages thereof, while simultaneously overcoming some of the disadvantages normally associated therewith.

Even still another object of the present invention is to provide a new and improved second-hand smoke filtering device for capturing and filtering cigarette smoke and second-hand cigarette smoke from a user smoking cigarettes.

Lastly, it is an object of the present invention to provide a new and improved second-hand smoke filtering device comprising a hollow body; a cigarette holder disposed within the body, the cigarette holder further comprising an elongated holding chamber adapted for the dual purpose of accepting a cigarette therein for smoking and holding second-hand smoke; igniter means disposed within the holding chamber for allowing the lighting of a cigarette when activated and preventing the lighting of a cigarette when deactivated; and drive means coupled to the igniter means for allowing the igniter means to be moved forward in one orientation and backward in another orientation; a mouthpiece extended from the body, the mouthpiece adapted for receiving smoke from a cigarette in the cigarette holder or smoke suspended within the holding chamber when a user inhales and transmitting second-hand smoke when a user exhales; a filter compartment disposed within the body for removing second-hand smoke; valve means disposed between the holding chamber, mouthpiece, cigarette holder, and filter compartment for controlling communication between the holding chamber, mouthpiece, cigarette holder, and filter compartment; and selection means coupled to the igniter means, drive means, valve means for selectively allowing a user to activate and deactivate the igniter means, move the igniter means forward in one orientation and backward in another orientation, and control communication between the holding chamber, mouthpiece, cigarette holder, and filter compartment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
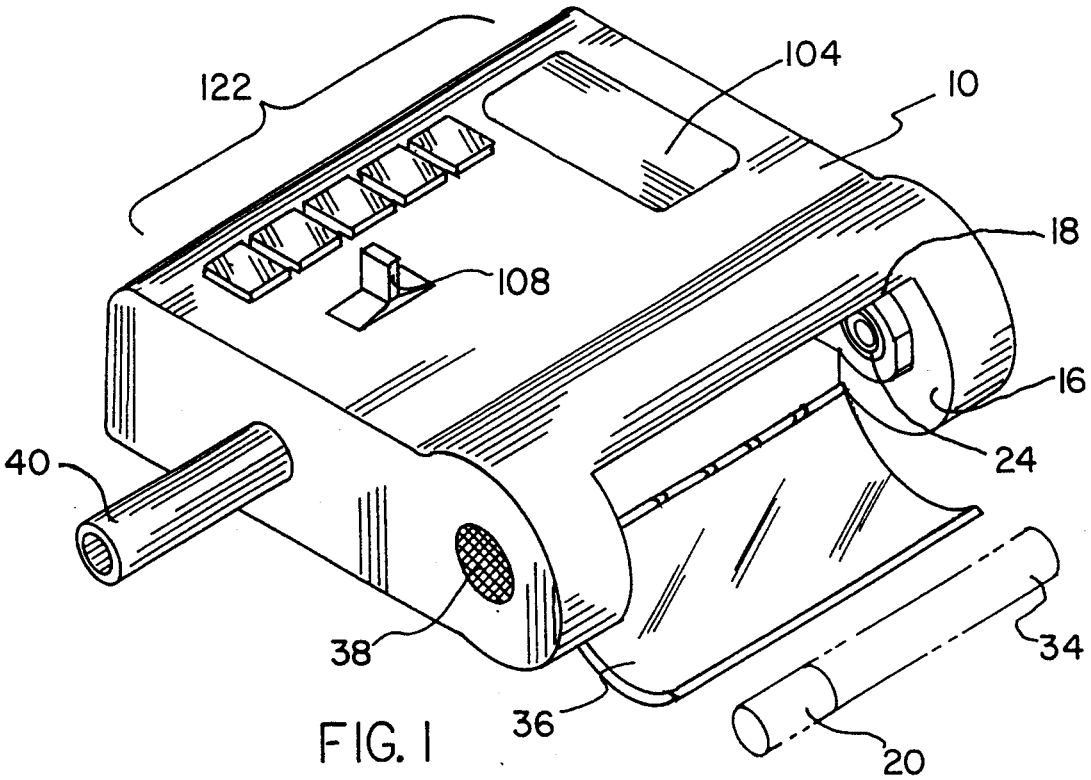
FIG. 1 is a perspective view of the preferred embodiment of the second-hand smoke filtering device constructed in accordance with the principles of the present invention.
Figure 2:
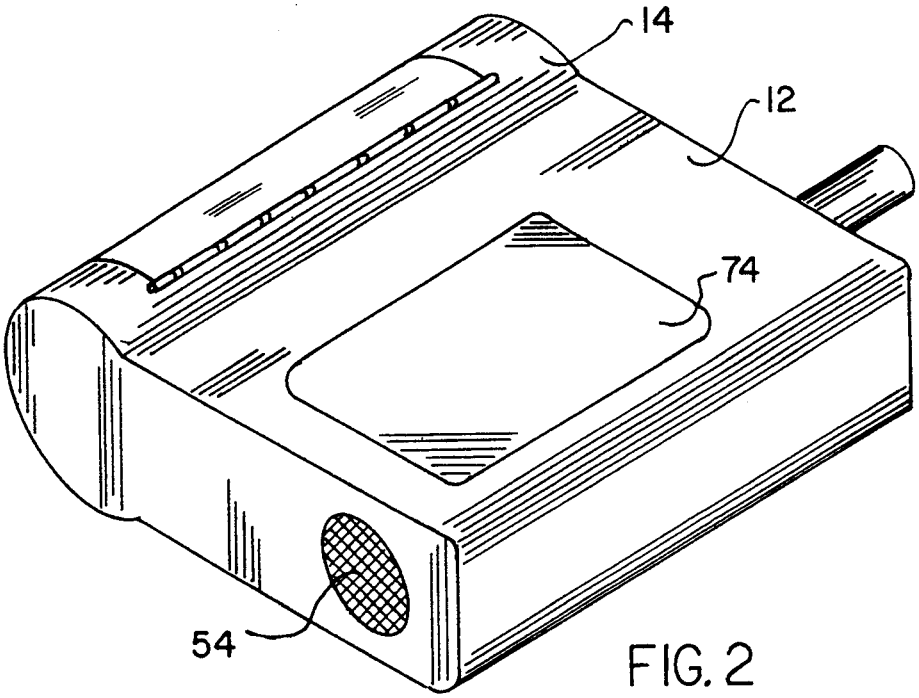
FIG. 2 is a perspective view of the bottom portion of the device.
Figure 3:
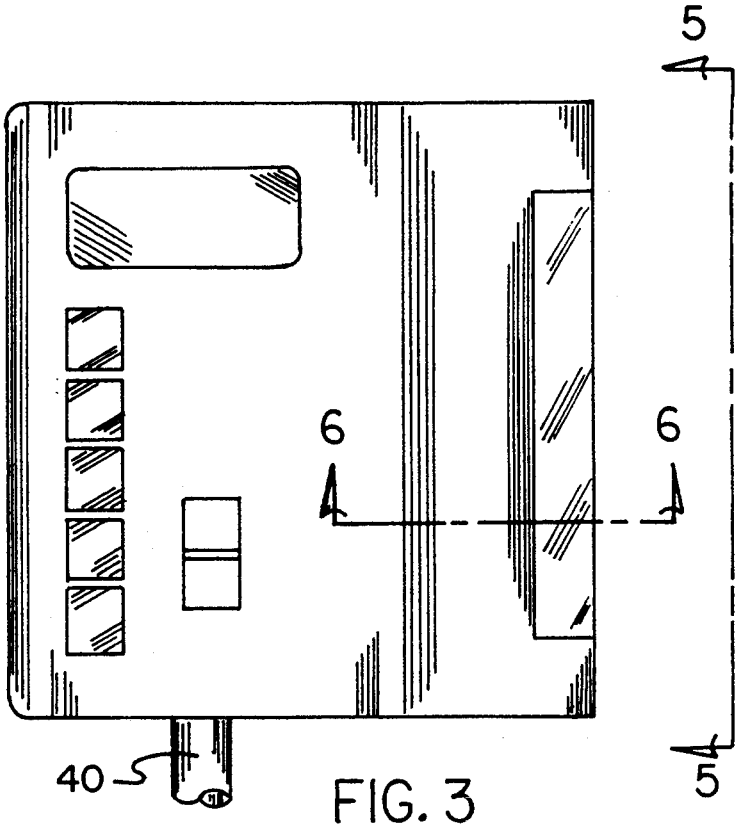
FIG. 3 is a plan view of the top portion of the device of FIG. 1.
Figure 4:
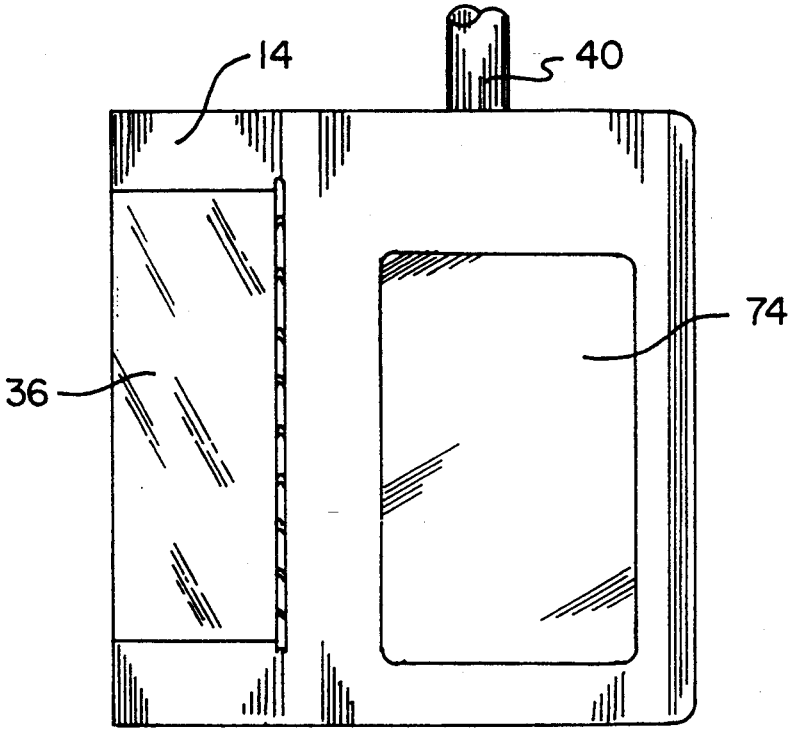
FIG. 4 is a plan view of the bottom portion of the device of FIG. 1.
Figure 5:
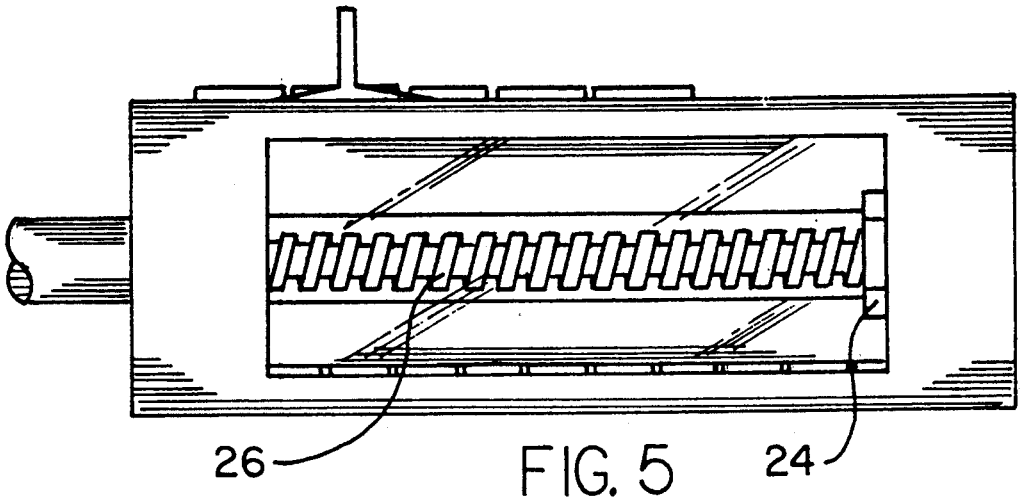
FIG. 5 is a side elevational view of the device taken along the line 5—5 of FIG. 3.
Figure 6:
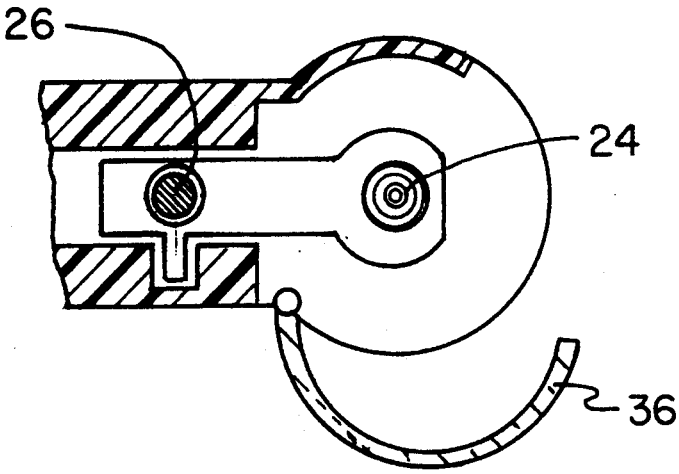
FIG. 6 is a cross-sectional view of the device taken along the line 6—6 of FIG. 3.

With reference now to the drawings, and in particular, to FIG. 1 thereof, the preferred embodiment of the new and improved second-hand smoke filtering device embodying the principles and concepts of the present invention and generally designated by the reference number 10 will be described.

Specifically, the present invention includes 10 major components. The major components are the body, cigarette holder, mouthpiece, filter compartment, filter door, check valve, power source, power source door, drive circuitry, and selection circuitry. These components are interrelated to provide the intended function.

More specifically, it will be noted in the various Figures that the first major component is the body 12. The body is hollow in structure. The body is used as a structure for holding the other components therein. The body is formed such that it can be easily held by a user.

The second major component is the cigarette holder 14. The cigarette holder is integrally coupled to the body 12. The cigarette holder includes 6 subcomponents. The subcomponents are the holding chamber, igniter, worm gear, gear motor, holding chamber door, and one-way valve. These subcomponents are interrelated to provide the intended function.

The first subcomponent of the cigarette holder is the holding chamber 16. The holding chamber is elongated in structure. It has an opening 18 adapted for allowing a user to place a cigarette 20 therein for smoking. The holding chamber has a fitting 42 disposed within the body adapted for holding a cigarette. The fitting 42 has an output port 22 adapted for transmitting cigarette smoke to another location. The holding chamber further has a port 44 disposed thereon adapted for transmitting second-hand smoke to another location.

The second subcomponent of the cigarette holder is the igniter 24. The igniter is disposed within the holding chamber. The igniter is adapted to be electrically driven. The igniter includes a thermally conductive coil adapted to contact the tip 34 of a cigarette. It has an energized orientation for allowing the lighting of a cigarette. It also has a de-energized orientation for preventing the lighting of a cigarette.

The third subcomponent of the cigarette holder is the worm gear 26. The worm gear is elongated, rigid, and threaded in structure. It has a first end and a second end. The second end is extended within the holding chamber and coupled to the igniter 24.

The fourth subcomponent of the cigarette holder is the gear motor 28. The gear motor has a fixed stator 30 and a rotatable rotor 32 disposed within the body 12. The rotor is coupled to the first end of the worm gear and is adapted for allowing the igniter to be moved forward in one orientation and backwards in another orientation. The forward orientation allows the igniter to be placed in contact with the tip of a cigarette for lighting.

The fifth subcomponent of the cigarette holder is the holding chamber door 36. The holding chamber door is transparent and curved in structure. It is pivotally coupled to the holding chamber near the opening 18. The holding chamber door is adapted to seal the opening. By sealing the opening, smoke from a cigarette is prevented from escaping the holding chamber.

The sixth subcomponent of the cigarette holder is the one-way valve 38. The one-way valve is disposed on the holding chamber 16. It is adapted for allowing air external to the body 12 to enter the holding chamber. It is also adapted to prevent smoke from a cigarette from escaping the holding chamber.

The third major component is the mouthpiece 40. The mouthpiece is tubular and rigid in structure. It is disposed within and extended from the body 12. The mouthpiece is adapted for receiving smoke from a cigarette placed in the cigarette fitting 42 or from second-hand smoke suspended within holding chamber 16 when a user inhales. The mouthpiece is also adapted for transmitting second-hand smoke from a user when the user exhales.

The fourth major component is the filter compartment 48. The filter compartment is disposed within the body 12 and is adapted for removing second-hand smoke from the air contained within the compartment. The filter compartment includes 3 subcomponents. The subcomponents are the filter chamber, the filter, and the fan. These subcomponents are interrelated to provide the intended function.

The first subcomponent of the filter compartment is the filter chamber 50. The filter chamber is elongated and rigid in structure. It has an input port 52 adapted for receiving second-hand smoke from a user. It also has an exhaust port 54 adapted for transmitting filtered air to a location external to the body 12.

The second subcomponent of the filter compartment is the filter 58. The filter is disposed between the input port and the exhaust port. It is adapted for removing second-hand cigarette smoke from the filter chamber 50. The filter has a porous and fiber-filled section 60 positioned adjacent to the input port 52. This fiber-filled section is adapted for removing large particulate matter from cigarette smoke. The filter also includes a perfumed pellet section 62 positioned adjacent to the exhaust port 54. The perfumed pellet section is adapted for adding a pleasing scent to the filtered air before the filtered air is released from the body through the exhaust port. The filter also includes a charcoal-filled section 64 disposed between the fiber-filled section and the perfumed pellet section. The charcoal-filled section is adapted for removing the remaining composites of second-hand smoke.

The third subcomponent of the filter compartment is the fan 70. The fan is disposed between the exhaust port 54 and the filter 58. It is used for removing the filtered air from the filter chamber.

The fifth major component is the filter door 74. The filter door is disposed on the body 12. It is adapted for allowing access to the filter 58 in the filter compartment 48 for replacement.

The sixth major component is the quadrature check valve 80. The check valve is rigid in structure and includes four tubular sections intersected at a common junction to define a first port 82, a second port 84, a third port 86, and a fourth port 88. The second port is coupled to the output port 22 of the cigarette fitting 42. The first port is coupled to the mouthpiece 40. The third port is coupled to the port 44 of the holding chamber 16. The fourth port is coupled to the input port 52 of the filter compartment. The check valve also includes 4 solenoid valves disposed therein. A first solenoid valve 90 is disposed within the first port 82. A second solenoid valve 92 is disposed within the second port 84. A third solenoid valve 94 is disposed within the third port 86. A fourth solenoid valve 96 is disposed within the fourth port 88. Each valve includes a sleeve portion mated with a plug portion with a spring portion therebetween and a coiled portion therearound. The coil portion is adapted to be electrically energized for allowing the plug and sleeve to operate magnetically. Each valve has an opened orientation when electrically energized for allowing communication therethrough and a closed orientation when de-energized for preventing communication therethrough.

The seventh major component is the power source 100. The power source is disposed within the body 12. It is coupled to the gear motor 28, fan 70, and solenoid valves 90, 92, 94, 96. The power source can also have a power input port 102 formed thereon and adapted for receiving external power for use. This external power could come from a cigarette lighter adaptor plug of a vehicle. In the preferred embodiment, the power source is rated at 9 volts and consists of a standard 9 volt battery.

The eighth major component is the power source door 104. The power source door is disposed on the body. It is used for allowing a user to access the power source 100 for maintenance or replacement thereof.

Figure 7:
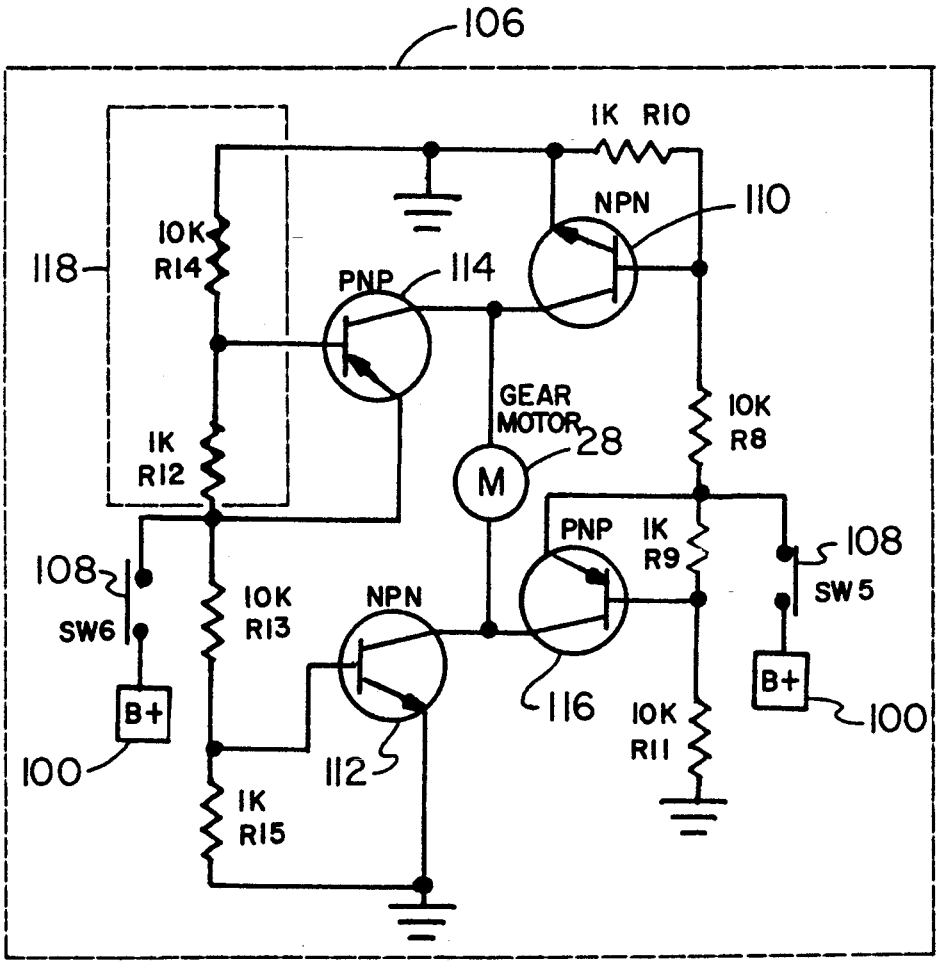
FIG. 7 is a schematic diagram of the drive circuitry used for controlling the igniter motor.
Figure 9:
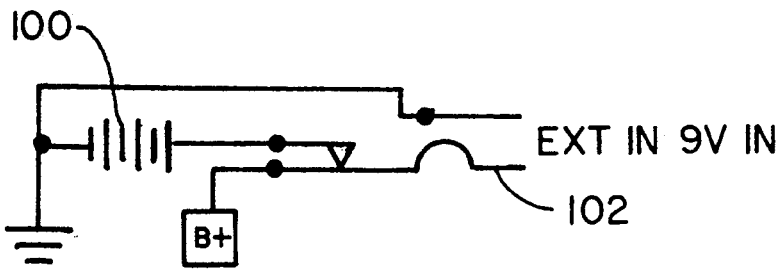
FIG. 9 is a schematic diagram of the power source of the present invention.

The ninth major component is the drive circuitry 106. The drive circuitry is disposed within the body 12 and coupled between the gear motor 28 and the power source 100. The drive circuitry has a toggle switch 108 coupled thereto and extended from the body. The switch is adapted for allowing a user to control the forward and rearward motion of the worm gear 26 for lighting a cigarette. The drive circuitry includes a network of NPN transistors 110, 112 and PNP transistors 116, 114 with each transistor having a terminal coupled to the gear motor 28. Each transistor is biased by a resistor network 118 for generating a voltage between the base and emitter for allowing the transistor to act as a switch. The toggle switch is actually comprised of two switches denoted as SW 5 and SW 6 as shown in FIG. 7. When the toggle switch is placed in the SW 6 position and closed, current flows to the gear motor through transistors 114 and 112 for rotating the rotor of the gear motor in one orientation. When the toggle switch is placed in the SW 5 position and closed, current flows from transistor 110 to transistor 116 for allowing the rotor of the motor to be rotated in another orientation. The rotatable orientations of the rotor allow the worm gear to be moved forward and backwards such that the igniter may be placed adjacent to the tip of a cigarette for lighting.

The tenth major component is the selection circuitry 120. The selection circuitry is disposed within the body 12 and coupled between the fan 70, solenoid valves 90, 92, 94, 96, the igniter 24, and the power source. The selection circuitry includes a plurality of switches 122 coupled thereto and extended from the body 12. The preferred embodiment includes five switches. Four of the switches are adapted for allowing a user to place selected solenoid valves in the opened orientation or the closed orientation. The remaining switch is used to place the igniter in an energized orientation for lighting a cigarette or a de-energized orientation. By allowing a user selected control of the solenoid valves, the flow of second-hand smoke between the cigarette holder, mouthpiece, holding chamber, and filter compartment can be controlled for the filtering operation. The selection circuitry includes a plurality of NPN transistors 124. Each transistor is used for switching a solenoid valve to an opened or closed position. A resistor network 126 is coupled between the transistors and switches 122 for generating a compatible switch bias voltage for each transistor. A plurality of diodes 128 is included with each diode connected to a collector of a transistor. Each diode is adapted for protecting the transistor from transient current spikes that may be generated by the switching of the solenoid valve. The selection circuitry also includes a voltage drop network 130 with each resistor in the network coupled between a solenoid valve and power source for allowing the proper voltage to be generated across the respective solenoid valve to allow its activation in an opened or a closed orientation.

The present invention is a device which allows cigarette smoking (machine or hand-rolled), without releasing second-hand smoke or smoke odor into the air. This device may allow the user to enjoy cigarette smoking in areas where normal smoking would be bothersome to others, discouraged, or even banned. Similar to a smokeless ashtray, the difference and advantage would be that the cigarette is never exposed to the outside air while it is burning.

Figure 8:
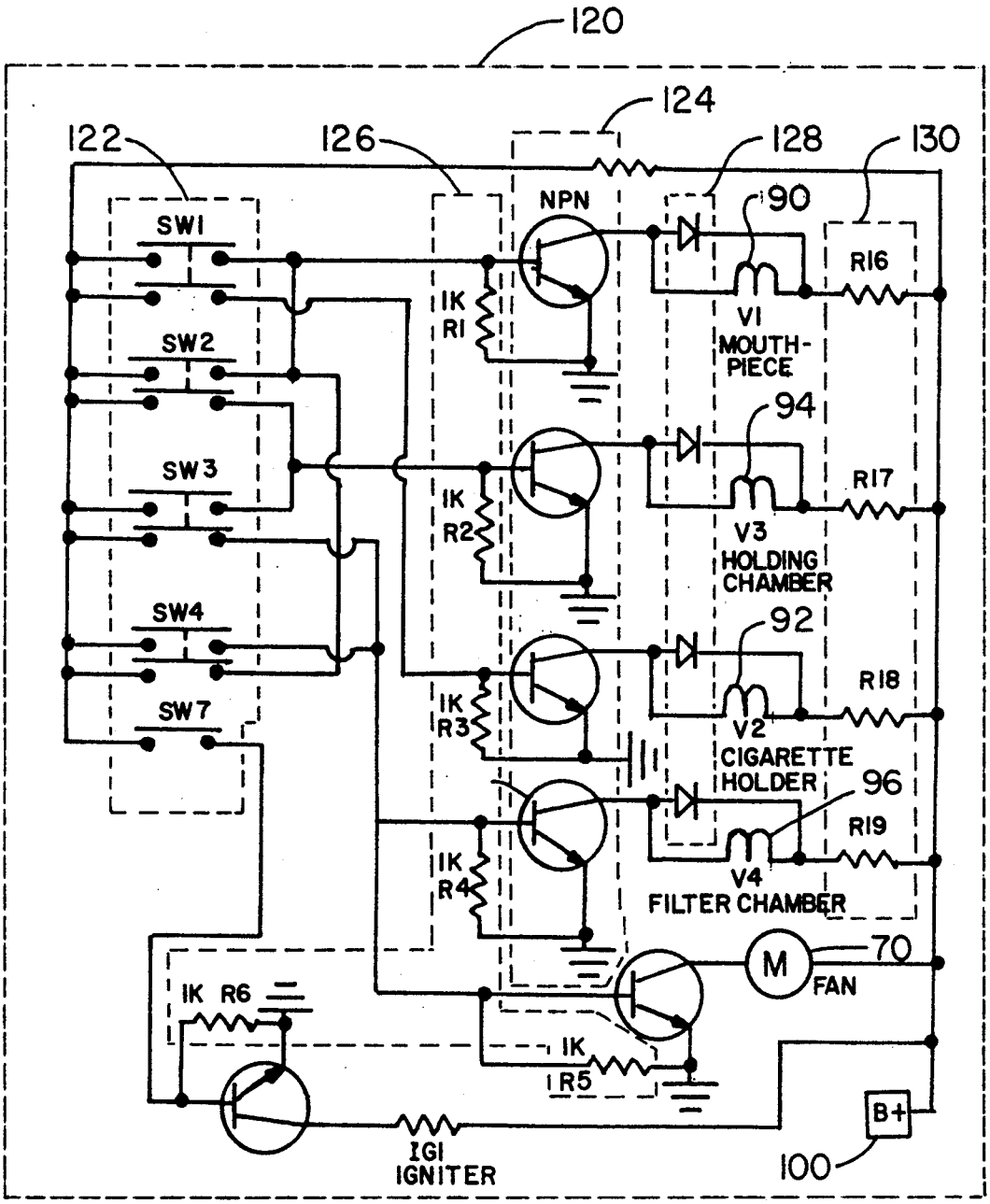
FIG. 8 is a schematic diagram of the selection circuitry used for controlling the solenoid valves, fan motor and igniter.
Figure 10:
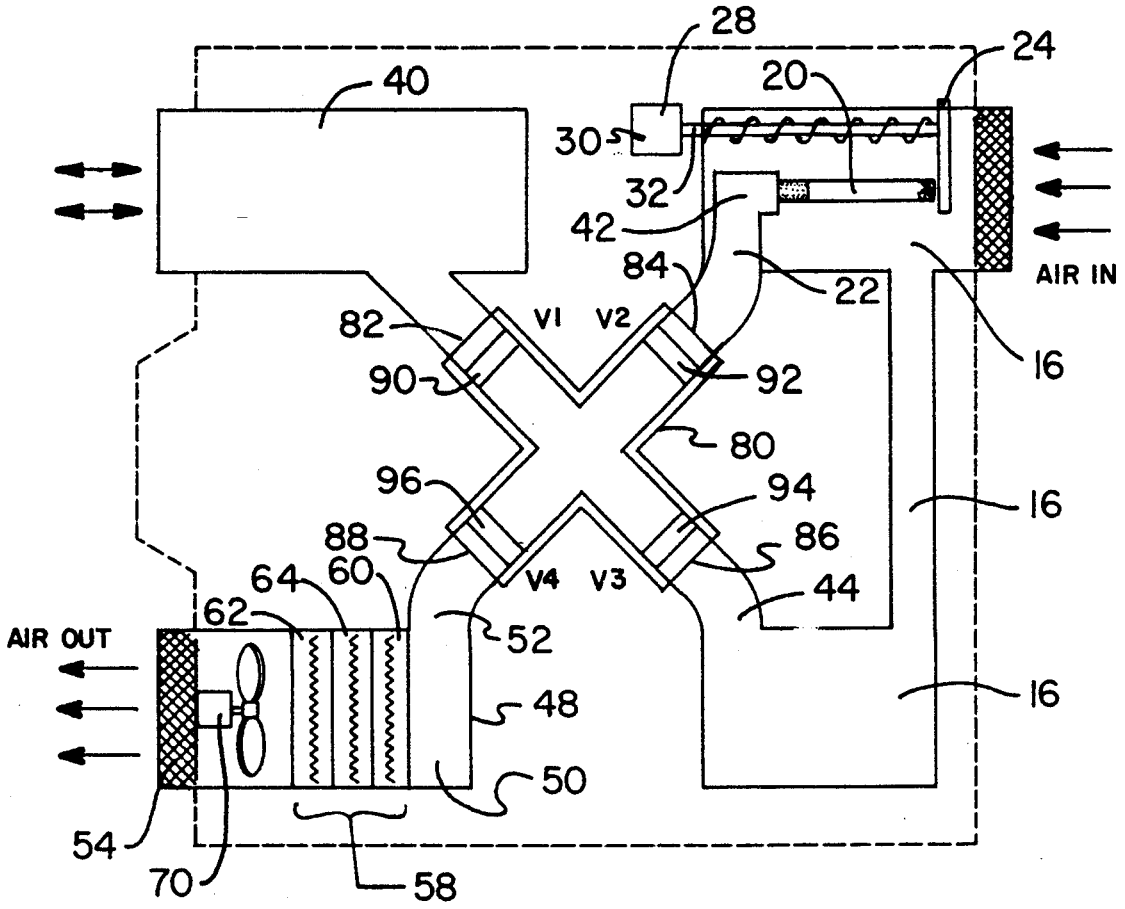
FIG. 10 is a schematic representation of the coupling between the quadrature check valve and the cigarette holder, mouthpiece, holding chamber, and filter compartment.

The cigarette is placed into a holder inside the device through a hinged, see-through glass door on the side. A toggle type control switch 108 is used to select the position of an internal igniter. With reference to FIGS. 7, 8, and 10, the SW 1, SW 2, SW 3, SW 4, and SW 7 switches are represented as user-selectable switches 122 fashioned in the form of buttons on the body. The SW 5 and SW 6 switches are represented as a user-selectable switch 108 on the body. The SW 1 control switch is activated to open a path from the cigarette holder, through a special valve, to the mouthpiece. When SW 1 is energized, V1 and V2 are opened. The SW 7 control switch is activated at this time, which energizes the internal igniter. Inhaling on the mouthpiece will light the cigarette. When the ignition phase is complete the igniter control switch is de-activated, and the igniter is de-energized. As long as the SW 1 control switch remains activated, smoke may continue to be inhaled by the user. When the inhaling phase is complete, the switch is deactivated. Valves V2 and V1 of the special valve close, sealing any smoke in the holding chamber. The special valve 80 is a solenoid operated valve with four solenoids. The four paths of the valve converge at a central point, with each solenoid placed between the intersection and the source or destination of each path.

The internal igniter is a holder made of ceramic material. A lighter element similar to a car cigar lighter is mounted upon the holder. The igniter is positioned within the holding chamber by a track molded into the hi-temperature resistant plastic case, and a small DC electric motor which drives a worm gear that is threaded into the ceramic holder. Depending upon which direction the motor spins, the igniter is either pulled toward, or pushed away from the tip of the cigarette. Since pressing both direction control switches (SW 5,6) simultaneously would cause a short circuit across the battery, a toggle type control switch 108 is used.

To exhale the inhaled smoke, the SW 4 control switch is pressed, which opens a path from the mouthpiece, through the solenoid valve to an internal fan-forced filtration unit. When SW 4 is energized, V1 and V4 are opened. The fan is also energized and the smoke is pulled from the mouthpiece into the filter. Filtered and scented exhaust is then passed to the outside through an exhaust port in the rear section of the case. Releasing the switch will de-energize the filter fan, V1 and V4.

The filter is a replaceable unit, accessible through a compartment door on the bottom of the device. The filter is a tri-sectional unit. The first section is a fiber filled area, the second section is a charcoal filled area, and the third section is an area filled with perfumed pellets. To inhale the smoke from the holding chamber, the SW 2 control switch is activated, which opens a path from the holding chamber, through the solenoid valve to the mouthpiece. When SW 2 is energized, V1 and V3 are opened. Releasing the switch will close the valves V1 and V3.

To expel smoke from the holding chamber, the SW 3 control switch is activated which opens a path from the holding chamber, through the solenoid valve to the fan-forced filtration unit. When SW 3 is energized, V3 and V4 are opened. The fan is also energized and the smoke is pulled from the holding chamber into the fan/-filter. Releasing the switch will de-energize the filter fan, and close V3 and V4. The device is battery operated. The battery is placed into a compartment, accessible through a door in the top of the device. The holding chamber is equipped with a Boston type, 1-way valve on the front of the device, to allow fresh air to enter the holding chamber, but not allow any smoke to leave.

The present invention allows a cigarette to be smoked and enjoyed without disturbing anyone or contaminating the air in the vicinity. This is accomplished with a plastic container into which an unlighted cigarette is placed. With switches provided on the unit, the cigarette is lighted, the smoke is inhaled, then exhaled back into the unit. There the smoke is filtered, purified and scented, then released into the air. Unless someone is familiar with the unit, they are not aware that a cigarette is being smoked. If they become aware, they are assured because the atmosphere has not been contaminated and they realize that they are perfectly safe from the effects of second-hand cigarette smoke.

The present invention is totally self contained, being operated by storage batteries mounted within it. A cigarette is placed in a holder through a hinged clear glass door on the side. The igniter is moved near the end by using a toggle switch which operates a small reversible motor on a gear rack assembly to position it. A button is pressed to open a chamber which leads from the cigarette holder to the mouthpiece through which the smoking will take place. At the press of another button, the cigarette is lighted, then the button is released. As long as the mouthpiece button is depressed, the smoke can be inhaled. At release, smoke is diverted to a holding chamber and the smoke is exhaled, assisted by a fan to pass it through high efficiency filters, including an activated charcoal section and one which applies a fragrant scent. Any smoke which has accumulated in the mouthpiece section can then be inhaled or evacuated by pressing buttons. Inhaling and exhaling modes are controlled by the buttons until the cigarette is allowed to lose its light. The filters are replaceable through an access door on the bottom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A second-hand smoke filtering device for capturing and filtering second-hand smoke from cigarettes comprising, in combination:

a hollow body;

a cigarette holder integrally coupled to the body, the cigarette holder further comprising:

an elongated holding chamber having an opening adapted for allowing a user to place a cigarette therein for smoking and an output port adapted for transmitting second-hand smoke;

holding means for holding a cigarette at a fixed position within the holding chamber and an output port adapted for transmitting cigarette smoke;

an igniter disposed within the holding chamber and having an energized orientation for allowing the lighting of a cigarette and de-energized orientation for preventing the lighting of a cigarette;

an elongated worm gear having a first end and a second end with the second end extended within the holding chamber and coupled to the igniter;

a gear motor having a fixed stator and a rotatable rotor disposed within the body, the rotor coupled to the first end of the worm gear for allowing the igniter to be moved forward in one orientation and backwards in another orientation with the forward orientation adapted for placing the igniter in contact with a tip of a cigarette for lighting;

a transparent holding chamber door pivotally coupled to the holding chamber near the opening, the door adapted to seal the opening and prevent smoke from escaping;

a one-way valve disposed on the holding chamber adapted for allowing air external to the body to enter and preventing smoke from escaping;

a tubular mouthpiece disposed within and extended from the body, the mouthpiece adapted for receiving smoke from a cigarette in the cigarette holder or second-hand smoke suspended within the holding chamber when a user inhales and transmitting second-hand smoke when a user exhales;

a filter compartment disposed within the body for removing second-hand smoke, the filter compartment further comprising:

an elongated filter chamber having an input port adapted for receiving second-hand smoke and an exhaust port adapted for transmitting filtered air to a location external to the body;

a replaceable filter disposed between the input port and the exhaust port for removing the second-hand cigarette smoke, the filter having a fiber-filled section positioned adjacent to the input port, a perfumed pellet section positioned adjacent to the exhaust port and a charcoal-filled section therebetween;

a fan disposed between the exhaust port and the filter for removing filtered air from the filter chamber;

a filter door disposed on the body for allowing access to the filter in the filter compartment;

a rigid quadrature check valve having:

four tubular sections intersected at a common junction to define a first port, a second port, a third port, and a fourth port with the second port coupled to the output port of the cigarette holder, the first port coupled to the mouthpiece, the third port coupled to the output port of the holding chamber, and the fourth port coupled to the input port of the filter compartment; and a first solenoid valve disposed within the first port, a second solenoid valve disposed within the second port, a third solenoid valve disposed within the third port, and a fourth solenoid valve disposed within the fourth port with each valve having an opened orientation when electrically energized for allowing communication therethrough an a closed orientation when de-energized for preventing communication therethrough;

a power source disposed within the body and coupled to the gear motor, fan, and solenoid valves;

a power source door disposed on the body for allowing access to the power source;

drive circuitry disposed within the body and coupled between the gear motor and the power source, the drive circuitry having a switch coupled thereto and extended from the body with the switch adapted for allowing a user to control the forward and rearward motion of the worm gear for lighting a cigarette; and selection circuitry disposed within the body and coupled between the fan, solenoid valves, igniter, and power source, the selection circuitry having a plurality of switches coupled thereto and extended from the body with the switches adapted for allowing a user to place selected solenoid valves in the opened orientation and the closed orientation and the igniter in an energized orientation and a de-energized orientation, whereby enabling a user to control the lighting of a cigarette as well as the communication of second-hand smoke between the cigarette holder, mouthpiece, holding chamber, and filter compartment.

2. A second-hand smoke filtering device for capturing and filtering smoke from a cigarette comprising:

a hollow body;

a cigarette holder disposed within the body, the cigarette holder further comprising:

a holding chamber adapted for accepting a cigarette therein for smoking;

holding means for holding a cigarette at a fixed position within the holding chamber;

igniter means disposed within the holding chamber for allowing the lighting of a cigarette when activated and preventing the lighting of a cigarette when deactivated; and drive means coupled to the igniter means for allowing the igniter means to be moved forward in one orientation and backward in another orientation;

a mouthpiece extended from the body, the mouthpiece adapted for receiving smoke from a cigarette in the cigarette holder or second-hand smoke suspeneded within the holding chamber when a user inhales and transmitting second-hand smoke when a user exhales;

a holding chamber disposed within the body for holding second-hand smoke;

a filter compartment disposed within the body for removing second-hand smoke;

valve means disposed between the holding chamber, mouthpiece, cigarette holder, and filter compartment for controlling communication between the holding chamber, mouthpiece, cigarette holder, and filter compartment; and selection means coupled to the igniter means, drive means, valve means for selectively allowing a user to activate and deactivate the igniter means, move the igniter means forward in one orientation and backward in another orientation, and control communication between the holding chamber, mouthpiece, cigarette holder, and filter compartment.

3. The second-hand smoke filtering device as set forth in claim 2 further including:

an exhaust port formed on the filter compartment;

a replaceable filter disposed within the filter compartment, the filter having a fiber-filled section positioned adjacent to the input port, a perfumed pellet section positioned adjacent to the exhaust port and a charcoal-filled section therebetween; and a fan disposed between the exhaust port and the filter for removing filtered air from the filter chamber.

4. The second-hand smoke filtering device as set forth in claim 2 further including a filter door disposed on the body for allowing access to the filter in the filter compartment.

5. The second-hand smoke filtering device as set forth in claim 2 further including a one-way valve disposed on the holding chamber adapted for allowing air external to the body to enter.

* * * * *